United States Patent [19]

Pergler

[11] 3,969,008

[45] July 13, 1976

[54] SAFETY LATCH AND DRAWER MOVEMENT SEQUENCING CONTROL ARRANGEMENT FOR FILE CABINETS

[75] Inventor: Charles C. Pergler, Aurora, Ill.

[73] Assignee: All-Steel Inc., Aurora, Ill.

[22] Filed: June 27, 1975

[21] Appl. No.: 590,880

[52] U.S. Cl. ..... 312/221; 312/218

[51] Int. Cl.[2] ..... E05C 7/06; E05C 15/04

[58] Field of Search ..... 312/107.5, 219–221, 312/273, 333; 292/138, 146; 49/307, 395

[56] References Cited

UNITED STATES PATENTS

| | | | |
|---|---|---|---|
| 2,719,770 | 10/1955 | Roberts | 312/221 |
| 2,842,419 | 7/1958 | Howard | 312/218 |
| 3,404,929 | 10/1968 | Wright et al. | 312/218 |
| 3,799,639 | 3/1974 | Friend | 312/221 |
| 3,874,755 | 4/1975 | Hegg | 312/221 |

*Primary Examiner*—Casmir A. Nunberg
*Attorney, Agent, or Firm*—Mann, Brown & McWilliams

[57] ABSTRACT

A safety latch and drawer movement sequencing control arrangement for file cabinets of the lateral and vertical file type, wherein the file equipment includes a filing cabinet equipped with a plurality of drawers mounted in superposed relation for independent horizontal shifting movement between open and closed positions, which includes a drawer movement sequencing device arranged to permit only one drawer at a time to be moved to open position, and a safety latch device that latches the unopened drawers against opening movement until the open drawer has been returned to closed position.

14 Claims, 10 Drawing Figures

50
18
65
22
67
190
192
196
194
76
90
95
98
92
75
71
169
59
79
162
164
73
77
79
160
72
70
206
93
202
204
90
96
94
92
95
84
142
18
74
40
204
93
90
67
99
76
76
52
72
142
70
68
38
136
86
142
138
140
34
138
84
36
90
136
88
134
86
168
82
89
81
84
91
134
140

FIG. 5
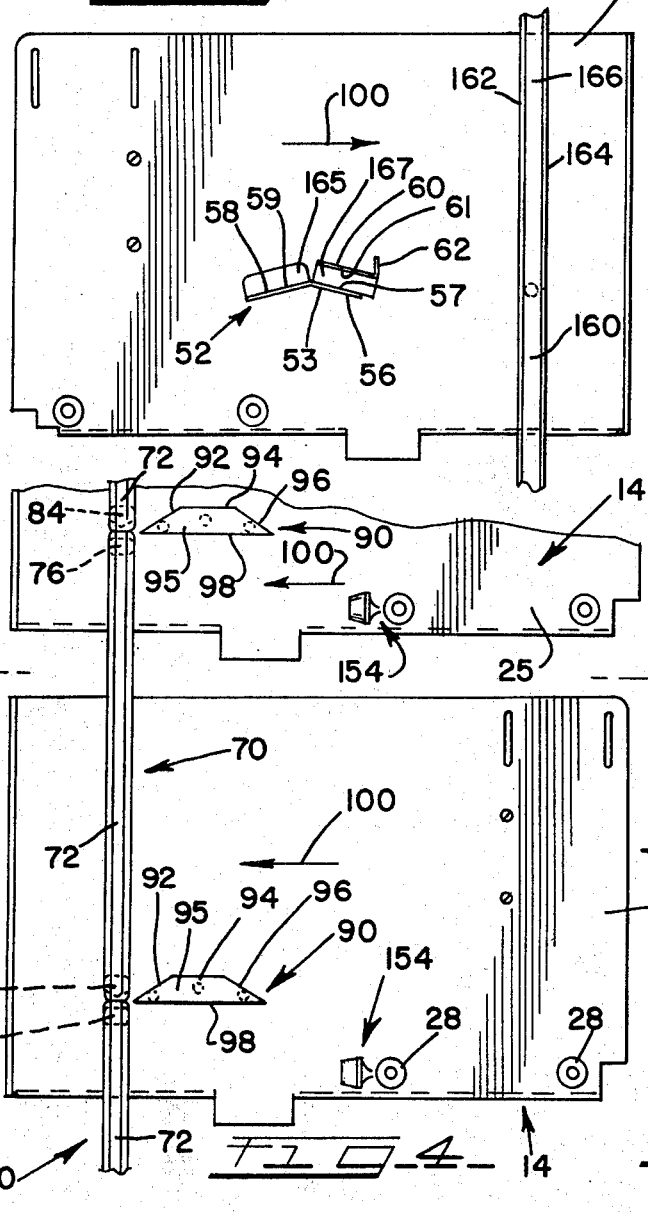
FIG. 4
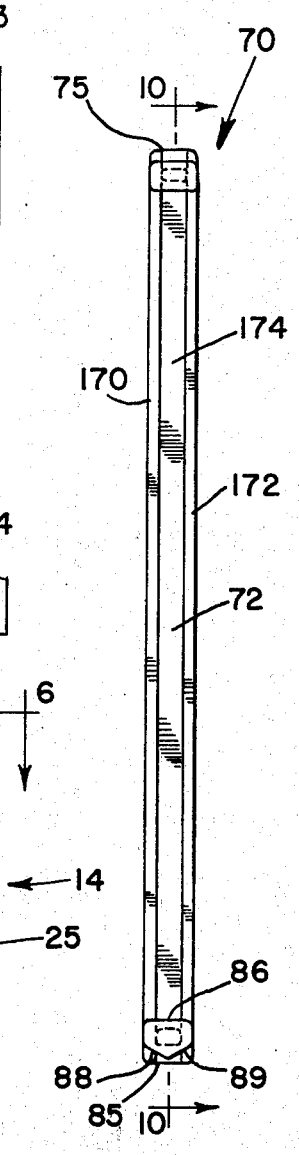
FIG. 9
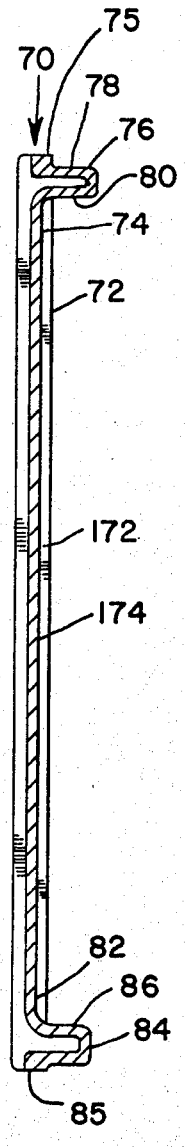
FIG. 10
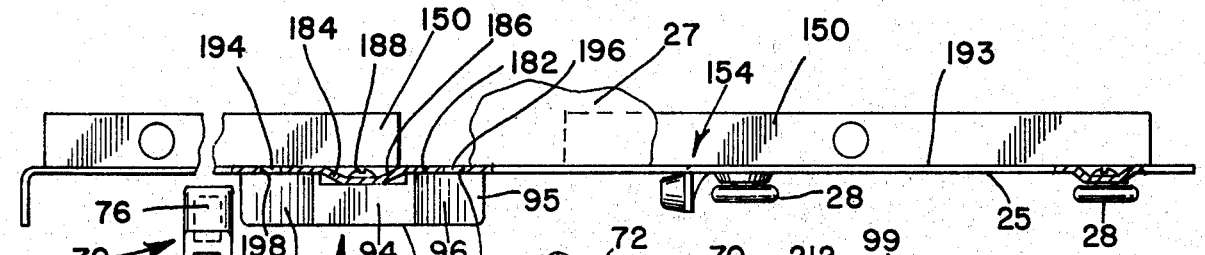
FIG. 6
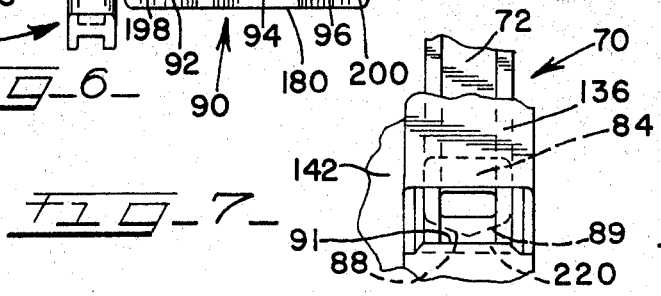
FIG. 7
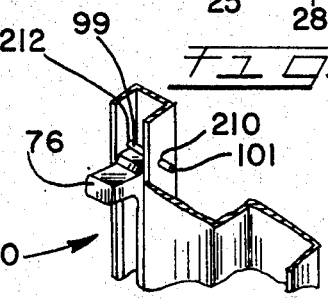
FIG. 8

SAFETY LATCH AND DRAWER MOVEMENT SEQUENCING CONTROL ARRANGEMENT FOR FILE CABINETS

This invention relates to filing cabinets, and more particularly, to office equipment filing cabinets of the lateral and vertical file types.

Lateral and vertical files comprise filing cabinets equipped with sets of drawers mounted in the cabinet in superposed relation for independent movement between open and closed positions. In vertical files the drawer is moved lengthwise of same between such positions, while in lateral files the movement is transversely of the drawer length, with the filing cabinets involved being arranged to accommodate these differences.

A commonly experienced problem in connection with filing cabinets of these types is that, assuming all drawers contain files, when more than one drawer at a time is moved to open position, the center of gravity change that takes place may be enough to result in a tendency of the cabinet to tip over forwardly. The higher the opened drawers are above the lowermost drawer, the greater the tendency to tip or tilt, with the problem being particularly acute for lateral files due to the fact that the basic shape involved permits the entire file to be moved to its open position with a relatively short amount of drawer movement relative to the file cabinet, and the long dimension of the file cabinet extends transversely of the path of movement of the drawers, which reduces the amount of center of gravity movement, on opening of the drawer or drawers, that will result in forward tipping tendencies.

There have been a number of prior efforts to avoid this tipping problem by building into the filing cabinet latching arrangements that are intended to permit only one drawer at a time to be moved to open position as by providing a vertically disposed latch bar that is positioned by the drawer being opened into a position to hold the other drawers against opening movement while the withdrawn drawer remains open. Several examples are shown in Bolesky and Saaf U.S. Pat. No. 2,240,067. More recent examples are shown in Roberts U.S. Pat. No. 2,719,770, Wright et al. U.S. Pat. No. 3,404,929, and Hegg U.S. Pat. No. 3,874,775.

A special problem experienced with this type of approach is that if two or more drawers are simultaneously moved to the open position, the latch bar operates in the same manner as if one drawer is being opened, and has no restraining effect on any of the moving drawers, with the result that the aforementioned filing cabinet tilting or tipping problem is still a possibility under the circumstances. This can be controlled to some extent by appropriate manual operation of the drawers, but experience has shown that where such files are improperly leveled and are located to be subject to vibrations (from adjacent machinery or the like), and the upper drawers are heavily loaded, the vibration can induce simultaneous movement of several of the drawers to open position, whereby tip over of the file can occur, if the file cabinet is not properly ganged with other files or anchored to a fixed structure.

A principal object of the present invention is to provide a safety latch and drawer movement sequencing control arrangement for drawer equipped file cabinets that limits drawer movement to open position to only one drawer at a time, as well as providing for positive latching of the other drawers against opening until the open drawer is returned to closed position.

Another important object of the invention is to provide a safety latch and drawer movement sequencing control arrangement in which the movement of a file drawer to open position operates in consecutive sequence a drawer movement sequencing device and a separate safety latch device that in combination insure full control over the movement of the drawers that will prevent the file tip over problem.

Other objects of the invention are to provide a safety latch and drawer movement sequencing control arrangement for drawer equipped file cabinets that is readily applicable to existing file cabinet designs, that may be built into the framing of the cabinet instead of requiring separate supports or mounting members that would take up additional space within the cabinet, and that is economical of manufacture, convenient to install, and reliable in operation.

In accordance with the present invention, the file cabinet is arranged to provide a safety latch device on one side of the file drawers and a drawer movement sequencing control device on the other side of the drawers, in association with vertical framing members of the cabinet which are formed to define vertical slideways along opposite sides of the drawers in association with which the respective devices operate. The safety latch device comprises a continuous latch bar mounted in one of the slideways for vertical movement therein under the action of cam members carried by the individual drawer sides facing the slideway involved, with the latch bar having a cam follower secured thereto for each drawer and disposed for camming engagement by the respective drawer camming members to, when one of the drawers is moved to its open position, dispose the latch bar such that the respective cam followers of same will block, and thus positively latch, the other drawers from movement to their open positions.

On the other side of the cabinet, the drawer movement sequencing control device is provided. Involved are a series of discrete stop bar segments applied in vertically stacked relation to the other slideway, with one of such segments being provided for each drawer in the file cabinet except for the top drawer. Each segment is elongated in nature and has a lower cam follower in the form of a lug for cooperation with a cam member applied to the drawer served by the particular stop bar segment in question, and an upper cam follower in the form of a lug that is disposed adjacent the level of the cam member of the next drawer above same. The cam follower forming lugs of each stop bar segment are spaced from their ends in accordance with the movement sequencing involved, with each drawer cam member of the drawer movement sequencing device defining forward and rearward oppositely inclined upwardly facing ramp surfaces separated by a horizontal upwardly facing guide surface, and on the underside of the individual cam members, a horizontal stop or abutment surface.

The stacked stop bar segments in their at rest position are supported on a suitable support at the lower end of the latch bar segment slideway to dispose each stop bar segment relative to the respective drawer so that the lower lug of each stop bar segment is at the level of the sequencing device cam member ramp surfaces, and the upper lug is somewhat below the sequencing device cam member abutment surface for the drawer immediately above.

When a single file drawer, of a file cabinet equipped with the invention is moved to open position, the movement sequencing control device cam member of that drawer engages the lower lug of the stop bar segment for that drawer and cams same, as well as the stop bar segments supported by it, upwardly over the cam member involved, and back down, under gravity, to the at rest position of the sequencing device stop bar segments, whereupon further outward movement of the drawer actuates and positions the latch bar so that the other file cabinet drawers will be positively latched against withdrawl movement. Return of the open drawer to closed position effects repositioning of both the sequencing device and latching device to initial position for further operation.

Should two drawers be pulled, or otherwise be moved, from the fully closed drawer toward the open position of same, the drawer movement sequencing device cam member of the lower drawer cams upwardly the stop bar segment controlled by it. Depending on whether or not the upper drawer moving out is immediately above the lower drawer or one or more drawer levels above that, the stop bar segments being raised are jammed against the sequencing control device cam member of the upper drawer being moved, thus preventing further movement of the lower drawer involved. Where vibration and improper leveling, lack of ganging, etc. allows the outward movement of the drawers in question, this ordinarily will be enough to hold them both against further movement toward open position. Where the drawers are being manually opened, the operator will then know that he cannot pull out the lower drawer involved, but he will be able to pull out the upper drawer involved, which immediately puts into operation the latch bar device to block opening of the lower drawer involved as well as the remaining drawers of the cabinet to provide the positive latching against drawer opening movement that is desired. Again, return of the open drawer to closed position automatically repositions both the drawer movement sequencing control device and the safety latch device for subsequent operation.

Other objects, uses and advantages will become obvious or be apparent from a consideration of the following detailed description and the application drawings.

In the drawings:

FIG. 1 is a diagrammatic partially exploded perspective view illustrating a three drawer lateral file arranged in accordance with the present invention;

FIG. 2 diagrammatically illustrates in fragmental perspective form the drawer movement sequencing control device and the drawer safety latch device that are employed in connection with the present invention, with parts being broken away or shown in broken line form for ease of illustration;

FIG. 4 is an elevational view of the exterior side of the right hand end of several vertically adjacent drawers of a multidrawer filing cabinent shown in operative association with the drawer movement sequencing control device of this invention;

FIG. 5 is an elevational view of the exterior side of the left hand end of one of the drawers of the filing cabinet of FIG. 1, showing same in operative association with the safety latch bar device of the invention;

FIG. 6 is a fragmental view taken substantially along line 6—6 of FIG. 4;

FIG. 7 is a fragmental elevational view of the lower end of the slideway for the drawer movement sequencing control device, taken from the back side of the cabinet frame member involved as shown in FIG. 2;

FIG. 8 is a fragmental perspective view showing the upper end of the drawer movement sequencing control device and associated cabinet frame member;

FIG. 9 is a plan view of one of the drawer movement sequencing control stop bar segments; and FIG. 10 is a cross-sectional view taken substantially along line 10—10 of FIG. 9.

However, it is to be distinctly understood that the specific drawing illustrations provided are supplied primarily to comply with the requirements of the Patent Laws, and that the invention is susceptible of other embodiments that will be obvious to those skilled in the art, which are intended to be covered by the appended claims.

GENERAL DESCRIPTION

Figure 1:
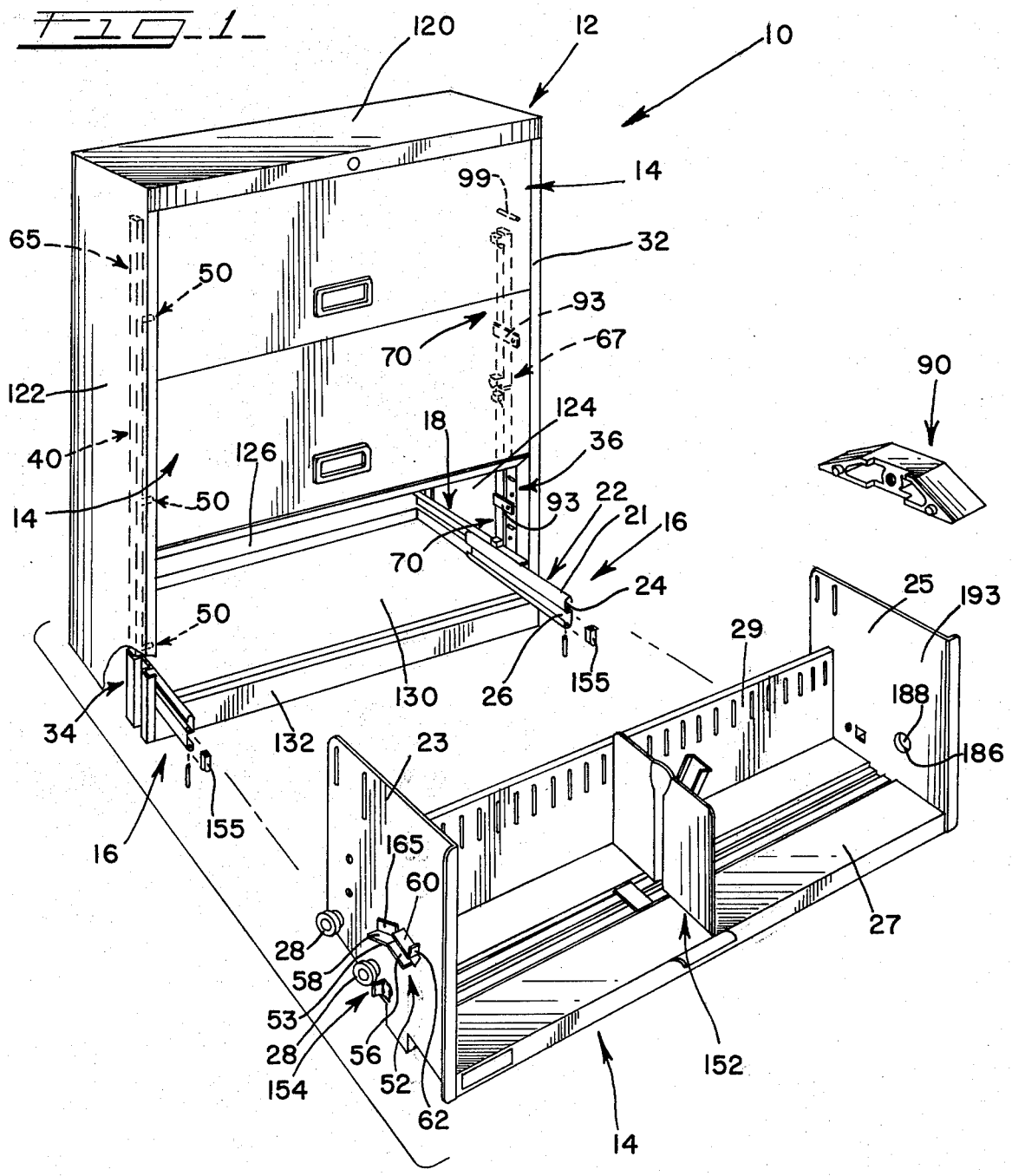

Reference numeral 10 of FIG. 1 generally indicates a lateral file comprising a cabinet 12 that is basically of more or less conventional construction which houses a plurality of lateral file drawers 14 (three in the embodiment shown), each of which is suspended on either side of same on a conventional progressive slide assembly 16 which, for each side of each drawer comprises a case slide component 18 of generally channel shaped cross-sectional configuration that has journalled on same a pair of rollers (not shown) which cooperate with a slide assembly 22. The slide assembly 22 on each side of the respective drawers comprises an elongate member 21 formed to define a rollerway 24 which receives the rollers of the case side 18, and which is formed with a second rollerway 26 which receives the rollers 28 that are journalled on the respective sides of the respective drawers 14, whereby the familiar easy rolling in and out of the file drawer 14 is provided.

The file drawers 14 are essentially of conventional construction suitable for a lateral file. The drawers shown comprising spaced sides 23 and 25 joined together by floor panel 27 and back panel 29 arranged in any suitable or convenient manner.

The filing cabinet 12 itself may be of any suitable construction, but in accordance with the invention, the cabinet includes at the front side 32 of same (that faces the observer in FIG. 1), front framing which includes an upright post or frame member 34 on the left hand side of same and a similar upright post or frame member 36 on the right hand side of same.

The posts 34 and 36 are of similar transverse cross-sectional configuration, and each is proportioned to extend the full height of the cabinet 12. A post 34 is formed to define along its full height a slideway 38 in which is mounted a continuous latch bar 40 carrying a plurality of spaced horizontally disposed rollers 50 that are equal in number to the drawers employed in the lateral file 10. The latch bar 40 is shown in dashed lines in FIG. 1 and extends substantially the height of the cabinet 12 except for a short spacing below the top of the cabinet to allow for the vertical movement of the latch bar 40 that is contemplated by the present invention. The case slides 18 secured to the left hand side of the cabinet for each drawer 14 lie directly across slideway 38 and hold bar 40 within slideway 38.

The side 23 of the respective drawers has applied thereto a cam member 52 which in the form shown comprises a bracket 53 having a forward inclined ramp portion 56 and a rearwardly inclined ramp portion 58 that respectively define upwardly facing ramp surfaces 57 and 59. The bracket 53 includes over the ramp surface 57 a flange portion 60 that is parallel to the ramp portion 56 and defines downwardly facing ramp surface 61. Flange portion 60 at its forward edge terminates in an upstanding stop arm or tab 62.

As indicated, each drawer 14 is provided with a cam member 52 similarly located on the drawer side 23 for cooperation with a correspondingly located roller 50 on the latch bar 40. The continuous latch bar 40, and its rollers 50, and the drawer cam members 52 form a safety latch device 65 which, when a drawer 14 is moved to open position, is intended to positively lock the remaining drawers against movement to the open position. In the form shown, the latch device 65 includes spring biased detent device 59 for releasably holding the latch bar 40 in its elevated position after being raised thereto by a drawer cam member 52 acting on same. Device 59 comprises leaf spring 71 secured to post 34 at its end 73, and having its end 75 equipped with a button 77 that is spring biased against bar 40 and adapted to lodge in recess 79 formed in bar 40 to releasably hold the bar in its upper position. The bar 40 at its lower end is equipped with a bumper 81 that engages the floor of the cabinet when the bar 40 is moved by one of the cam members 52 to release the bar 40 from device 59 (whereby the bar 40 is disposed in the position of FIG. 5 relative to the drawer cam members 52.)

Operably associated with the cabinet 12 and the safety latch device 65 is the drawer movement sequencing control device 67 (see FIGS. 2, 3 and 4) that is operably associated with the cabinet frame member 36.

The frame member 36 is formed to define slideway 68 that extends the full height of the cabinet 12 and has mounted in same a plurality of stop bar segments 70, one of which is shown in FIGS. 9 and 10.

The latch bar segments 70 each comprise an elongate member 72 having at its upper end 74 an upper transversely extending lug 76 defining an upwardly facing planar surface 78 and a downwardly facing planar surface 80. At the lower end 82 of each member 72 the members 72 each have a transversely extending lug 84 having a planar upwardly facing surface 86 and angled downwardly facing surfaces 88 and 89.

Figures 2, 3:
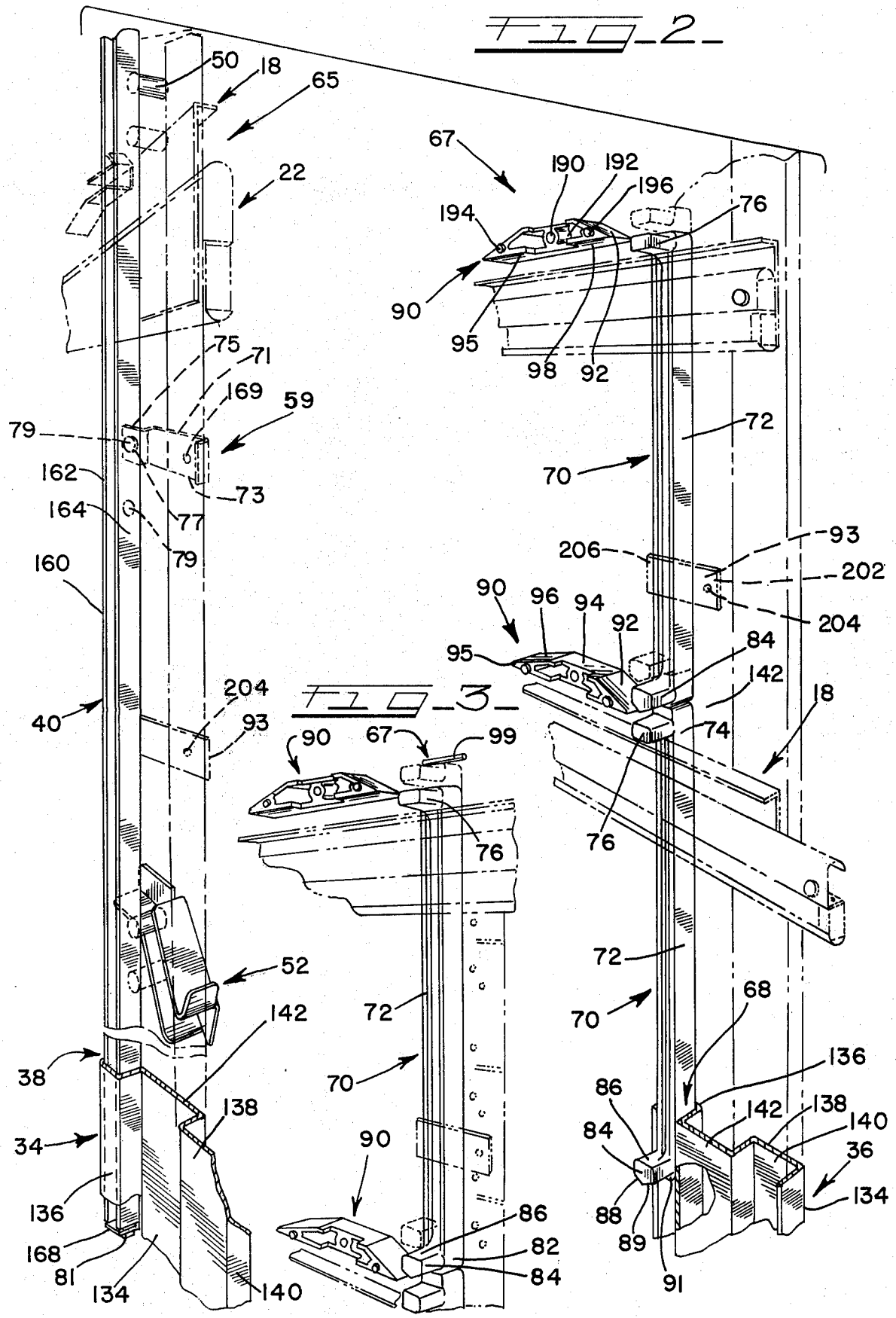
FIG. 3 is a fragmental perspective view of the upper end of the drawer movement sequencing control device, indicating how the uppermost drawer in a file cabinet is controlled in accordance with the invention.

As indicated in the drawings, the lugs 76 and 84 are in coplanar parallel relation and the segments 70 are separate and discrete, and are stacked in end to end vertically disposed relation within the slideway 68. The post or frame member 36 adjacent its lower end is provided with an inwardly directed tab 91 (see FIG. 7) on which the stop bar segments 70 rest in stacked superposed relation. The case slides 18 are fixed within the cabinet 12 across the slideway 68 maintain the segments 70 within the slideway 68, and alternately, or in addition, retainer plates 93, suitably affixed to the post 36 across the open side of slideway 68, may be employed for this purpose, as indicated in FIGS. 1 and 2. The plates 93 may also be applied to post 34 to serve the same purpose for lock bar 40, as indicated in FIG. 2.

The stop bar segments 70 in their at rest position are disposed relative to the respective drawers 14 in the manner indicated in FIGS. 1, 2 and 4, and in operative association with a cam member 90 that is fixed to the respective drawer sides 25. The cam member 90 for each drawer generally comprises a cam body 95 formed to define a forwardly upwardly facing ramp surface 92, a horizontally disposed guide surface 94 and a rearwardly upwardly facing ramp surface 96, as well as a downwardly facing horizontal stop or abutment surface 98.

As indicated in FIG. 4, the stop bar segments 70 are oriented relative to the respective drawers 14 such that for each drawer 14 (except for the topmost drawer 14), there is a stop bar segment 70 disposed to have its lower lug 84 at the level of the ramp surfaces 92 and 96 of cam member 90 of such drawer, and its upper lug 76 disposed below but closely adjacent to the level of the downwardly facing stop or abutment surface 98 of the cam member of the drawer immediately above same. As indicated in FIGS. 9 and 10, the lugs 76 and 84 of the respective segments 70 are spaced from their respective upper and lower terminal end surfaces 75 and 85. This is to allow for the relative movement between the drawers and segments 70 that is involved in accordance with the invention to control the sequence of movement of the drawers 14 from their closed positions to their open positions.

It is also to be noted that in the at rest position of the segments 70, the lower end surface 85 of a segment 70 rests on an upper end surface 75 of the next segment below the segment 70 in question. The lowermost segment 70 rests on the support flange 91 of slideway 68 (see FIG. 7) and has its lower lug 84 disposed at the level of the ramp surfaces 92 and 96 of the cam member 90 of the lowermost drawer 14, by appropriate locations of the flange 91.

At the upper end of the slideway 68, the uppermost segment 70 has its lug 76 disposed just below the level of the cam member 90 for the upper most drawer 14, and adjacent a stop device 99 that is in the form of a pin 101 fixed across the slideway 68 (see FIG. 8).

In the form shown, the latch bar 40 of device 65 and the stop bar segments 70 of the device 67 are located at approximately the same position longitudinally of the path of movement of the respective file drawers 14. However, as indicated in FIGS. 4 and 5, the cam members 90 of the respective drawer sides 25 are located forwardly of the cam members 52 of the respective drawer sides 23 so that as an individual drawer 14 is moved in the direction of the arrows 100 of FIGS. 4 and 5, the devices 65 and 67 function sequentially, with the device 67 functioning prior to the device 65.

In operation, assuming that a single drawer 14 is moved outwardly of the cabinet 12 from its closed to its open position, in the direction of the arrows 100 of FIGS. 4 and 5, and assuming that the drawer 14 in question is the middle drawer of FIG. 1 (and that for purposes of this discussion, the same drawer is the lower drawer of FIG. 4), the outward movement of the single drawer being considered brings the ramp surface 92 of its cam member 90 against the angled undersurface 88 of the middle stop bar segment 70 shown in FIG. 4, which cams upwardly such stop segment 70 and the segment or segments supported by same. As it is assumed for purposes of this discussion that only one file drawer 14 is being moved outwardly, the drawer 14 in question continues to move outwardly, camming upwardly the stop bar segments 70 level with or above its cam member 90, across the guide surface 94, and then down the ramp surface 96, which returns the stop bar segments that have been elevated by this action back to a position of rest on the stop bar segment 70, immediately beneath same.

In the meantime, the cam member 52 of the drawer in question moves toward the roller 50 of latch bar 40 level with same (see FIG. 5) and the roller 50 in question is entered into the bracket 53, cammed upwardly by ramp surface 57 to dispose the lock bar 40 in its elevated operative position, in which it is releasably held by detent device 59 wherein the rollers 50 that cooperate with the other doors 14 are disposed at the level of the stop flange 62 of the other drawers. The latching device 59 functions to continue to hold the latch bar 40 in such elevated operative position (with button 77 lodged in recess 79) as the drawer 14 is moved to and reaches its fully open position.

On returning the open drawer 14 in question to closed position, the roller 50 (of the latch device 65) for the open drawer is engaged by the ramp surface 61 of the cam member 52 for that drawer to cam bar 40 free of device 59, which results in bar 40 returning to its inoperative at rest position. Continued movement of the drawer brings the cam member 90 on the other side of the drawer in question into camming engagement with the stop bar segment 70 initially actuated by that drawer to cam same over the top of the cam member 90 and back to initial at rest position.

It will thus be seen that when a single drawer 14 is moved to open position, the drawer movement sequencing device 67 merely idles while the safety latch device 65 is automatically disposed in operative position to positively latch the unopened drawers 14 against withdrawal beyond the position wherein the stop flanges 62 will engage the rollers 50 involved.

However, when two drawers 14 move outwardly of the cabinet 12 toward open position, at the same time, the stop bar segment 70 that has its lug 84 controlled by the lower drawer being moved outwardly is moved upwardly by the drawer cam member 90 to dispose a bar segment 70 lug 76 against the undersurface 98 of the cam member 90 of the upper drawer that is moving outwardly. If the two drawers moving outwardly are vertically adjacent, then the stop bar segment 70 actuated by the lower drawer engages the undersurface 98 of the cam member 90 of the drawer immediately above it. Where the upper drawer moving outwardly is spaced at a drawer level two or more drawers above the lower drawer in question, then the stop bar segments 70 intervening between such lower moving drawer and the upper moving drawer in question are moved upwardly as indicated for bringing the segment lug 76 that is at the level of the upper moving drawer into engagement with the undersurface 98 of the upper outwardly moving drawer cam member 90.

In any event, the camming action involved provided by the cam member 90 of the lower outwardly moving drawer jams the segments 70 intervening between the lower and upper outwardly moving drawers against the undersurface of the cam member 90 of the upper outwardly moving drawer, thereby effectively stopping outward movement of the lower outwardly moving drawer due to the wedging action involved at the cam member of the lower outwardly moving drawer.

Should the outward drawer movement in question be caused by vibration and be unintended, such drawers will then be held in the partially open position due to the jamming of the stop bar segments 70 in between the cam members of the respective partially opened drawers, thereby avoiding full outward movement of both drawers and possible tip over of the file.

The upper drawer may be pulled outwardly, if so desired, which brings into operation the safety latch device 65 that will then preclude full outward movement of the lower drawer in question.

Where such drawers 14 are pulled to open position simultaneously manually, the same operation occurs with the operator then having the option of continuing to pull out the upper drawer to fully open position, but not the lower drawer, which in practice must be backed back into the cabinet somewhat to release the jammed stop bar segments involved.

The stop 99 of FIG. 8 is required for situations where, two drawers 14 move toward open position simultaneously, and the lower drawer is moved sufficiently ahead of the upper drawer being moved to raise the stack of stop bar segments cammed by it so that the stop bar segment lug 76 that is at the level of the upper drawer being moved is raised to the point where the ramp surface 92 of such upper drawer cam member engages the underside 80 of said upper lug 76 (rather than such upper lug engaging the upper drawer cam member under surface 98); in such event further movement of such upper drawer outwardly of the cabinet will jam the topmost stop bar segment 70 against the stop 99 to hold such upper drawer against further outward movement. In this instance, it is the lower outwardly moving drawer that can continue to be moved toward open position, as the stop bar segments 70 it cams will not be wedged against vertical movement.

It will thus be seen that the invention provides a two sequence drawer movement control system in which the device 67 operates to insure that only one drawer may be conveniently moved to open position, while the device 65 positively latches the unopened drawers against opening. When only one drawer is moved from the cabinet the device 67 merely idles, but the device 65 provides a positive locking function each time a drawer is moved to the open position.

SPECIFIC DESCRIPTION

The illustrated lateral file 10 is merely an example of the numerous types of lateral and vertical files to which the invention may be applied, as will be immediately apparent to those skilled in this art. The lateral file 10 is of simplified form involving three drawers of uniform depths, none of which are separated by special equipment items such as a draw tray or the like.

The cabinet 12 may be of any conventional construction, the front posts or framing members 34 and 36 being merely illustrative of the various types of framing members that may be employed to define the slideways 38 and 68. In the form shown, the slideways 38 and 68 are formed by structural configurations integral with the front framing members of the cabinet 12, but it is quite apparent that the slideways 38 and 68 may be formed by separate channel shaped members suitably secured in vertically disposed upright position.

The cabinet 12 includes the usual top 120, side walls 122 and 124, rear wall 126, floor 130, and foot panel 132. These components, as well as the cabinet framing 12, may be of any suitable nature or construction, except, of course, with regard to the guideways 38 and 68.

In the form shown, the framing members or posts 34 and 36 each comprise a length of formed metal stripping 134 indented as at 136 to define the guideways 38 and 68, respectively, and indented as at 138 to define a structural channel shaped portion 140 when it is applied at the front corners of the cabinet 12.

The posts 34 and 36 thus define a planar web portion 142 to which the case slides 18, the leaf spring biasing device 59 and the retainer devices 93 may be secured.

The case slides 18 are entirely conventional in nature and are suitably secured to the cabinet framing in any appropriate manner. The case slides 18 are disposed, however, so that they overlie the slideway 68 to serve as a means for maintaining the discrete stop bar segments 70 in their stacked operative relation. Of course, the positioning of the case slides 18 and the location of the rollers 28 that are applied to the drawers should be such that the case slides will not interfere with the movement of the stop bar lugs 76 and 84 that is contemplated by the present invention.

The drawers 14, aside from the application thereto of the cam members 52 and 90, are of entirely conventional construction. In the form shown, the drawers 14 involve the sides 25 and 23 being secured to the floor 27 and the back 29 by spot welding or the like, with the sides 23 and 25 being flanged as at 150 for this purpose (see FIG. 6).

The drawer 14 illustrated is provided with a conventional adjustable divider indicated at 152 of an entirely conventional design. The drawers also include a conventional stop indicated at 154 that engages the resilient bumper 155 of slide assembly 22 (see FIG. 1), limiting outward movement of the drawers. Where the case slide mounted drawer suspension is not employed, retainer plates 93 are employed for each stop bar segment 70 to maintain the segments 70 in stacked relation, with one retainer plate 93 per segment 70 being adequate. On the latch device 65 side of the cabinet, two retainer plates 93 adjacent the upper and lower ends of slideway 38 will suffice in place of the case slides.

With further regard to the safety latch device 65, the latch bar 40 is an elongate member 160 of channel shaped transverse cross-sectional configuration defining side flanges 162 and 164 and web 166.

The rollers 50 are preferably formed from a self lubricating material such as Nylon, and are suitably journaled on the web 166 in the positions previously indicated (for rotation about horizontal axes) such that, for the respective drawers 14, the respective rollers 50 will be disposed at the level of the drawer cam members 52 (see FIG. 5).

The drawer cam members 52 are formed from a suitable metallic material, shaped as indicated in the drawings, and affixed to the drawer side 23, as by employing spot welding. For this purpose members 52 define wall portions 165 and 167 that are spot welded to the drawer side 23.

The spring device 59 involves the illustrated leaf spring 71 which is secured to the frame member 34 at some convenient point along its location for cooperation with indentation 79 that is formed in the web of member 160 for this purpose. In the form shown, leaf spring 71 is screwed to frame member 34 as at 169, and has its ends angled over for interfilling relation with the frame member portion 140. Device 59 may be located at any suitable position along the length of bar 40.

The latch bar 40 at its lower end has bumper plate 168 affixed thereto to which the rubber bumper is attached. As indicated, the latch bar 40 in its at rest position (see FIG. 5) rests on the flooring 130 of the cabinet or other suitable fixed surface that disposes the respective rollers 50 with respect to the drawer cam members 52 in the manner indicated in FIG. 5.

With regard to the drawermovement sequencing control device 67, the individual stop bar segments 70 are preferably formed from a suitable plastic material, such as ABS, SRS grade, or ABS, GSM grade. The individual segments 70 are of I shaped transverse cross-sectional configuration intermediate their lugs 76 and 84, thus defining side flanges 170 and 172 integrally connected by web 174. The hollow configuration of the lugs 76 and 84 shown in FIG. 10 is a manufacturing convenience as part of the injection molding procedures employed for the particular segment 70 that is illustrated.

The individual segments 70 are proportioned in length to correspond to the vertical distance between the level of a cam member 90 of a particular drawer and the level of the cam member 90 of the next drawer above the drawer in question, to provide the operating lug relationships indicated in FIG. 4. Thus, where a particular cabinet has drawers of different heights the stop bar segments 70 will vary in length accordingly. Similarly, where the cabinet involved has something other than a drawer inbetween adjacent drawers, such a filler panel, or a pull out posting shelf, the segment 70 reaching from the drawer immediately below same will have a length proportioned to reach the indicated cam member 90 of the next drawer above such panel or posting shelf.

The angling of the lug surfaces 88 and 89 is preferably the same as the angling of the ramp surfaces 92 and 96 for maximum load bearing capabilities, which is preferably thirty degrees. The jamming of the segments 70 that is involved in the operation of the device 67 will occur when the surface 88 is in engagement with the cam member surface 92. When the individual segments 70 are riding on the surface 94, this will be during an idling of the device 67 wherein only the weight of the segments 70 above the segment in question will be involved. The stop segment cam surfaces 89 are engaged by the cam member cam surfaces 96 on closing of the drawer involved to separate the stack segments so as to permit return of an opened drawer to closed position.

The cam member 90 is in the form of a body 95 shaped as illustrated from a suitable self-lubricating material such as high density polyethyelene. In the form shown, the body 95 is of the double wedge configuration indicated, and defines an outer planar side 180 (see FIG. 6), and an inner side 182 which is indented at 184 to receive indentation 186 that is formed in the drawer side wall 25 that is suitably perforated to receive securement screw 188 that is threadedly received in the bore 190 of sleeve portion 192 of the member 90 which is integrally connected with the body 95 as indicated in FIG. 2.

This relationship of parts permits a recessing into the drawer side 25 of the screw 188 that secures the cam member 90 in place (see FIG. 6), so that in inside surface 193 of the drawer side will be free of projections that might damage materials to be filed.

The cam member 90 also is formed to define spaced apart integral studs 194 and 196 that are applied to appropriately located apertures 198 and 200 of the drawer side 25, to key the cam member 90 to the drawer side against rotational displacement movement (only one screw 188 per member 90 being employed).

The retainer plates 93 are of rectangular quadrilateral configuration having their ends 202 suitably secured to the web 142 of the post or frame member 36, as by employing a suitable fastening device 204, (such as a screw) and their ends 206 overlying the guideway 68 and the segments 70 located therein at the point where the plate 93 is applied, in the manner suggested by FIG. 2.

The stop 99 is in the form of a pin 101, which in one form of the invention comprises a rolled piece of sheet metal pressfitted into suitable openings 210 and 212 formed in the frame member 36 for this purpose.

At the lower end of the frame member 36, the stop tab 91 is defined by a flange 220 formed in the indentation 136 of the frame member 36 and angled crosswise of slideway 68 to form the lower end of same. The flange 220, of course, is located relative to the drawers so that the individual stop bar segments 70 are disposed relative to the cam members 90 of the respective drawers in the manner that is indicated in FIG. 4.

In one specific form of the invention, the cam members 52 are applied to the drawer sides 23 approximately one and three quarters inch rearwardly of the cam members 90, lengthwise of drawer opening movement.

It will therefore be seen that the invention provides a two phase control system over the movement of the file cabinet drawers 14 to open position. The door opening sequencing control device insures that only one drawer at a time will be movable to open position, and the safety latch device 65 positively latches the remaining drawers in closed position.

In situations where a file cabinet equipped with the invention is located where it will be subject to vibrations and the like that will cause or tend to cause drawer movement from the closed position, (where loads in the drawers and slanted floor conditions may be conducive to this), the device 67 serves as a drawer movement stop should more than one drawer tend to move to open position simultaneously. One drawer moved to open position ordinarily will not adequately move the center of gravity of the filing cabinet to cause undue tipping tendencies.

The arrangement of the devices 65 and 67 is that they can accommodate situations where the cabinet is to include drawers of varient depths as well as intermediate structures such as blank panels or pull out trays and the like. Thus, where blank panels or special convenience items such as pull out posting shelves are to intervene between a pair of vertically adjacent drawers, the stop segments 70 involved for such drawers, as well as the latch bar 40 bridge the non-drawer structures in question, with the rollers of bar 40 being located to control the drawers above same as indicated in FIG. 5, and the bridging segment 70 being proportioned in length to dispose its upper lug as indicated in FIG. 4 relative to the cam member 90 of the next vertical adjacent upper drawer.

It will also be apparent that, by making appropriate engineering revisions, the positioning of the devices 65 and 67, as to the sides of the drawers involved, may be reversed.

The foregoing description and the drawings are given merely to explain and illustrate the invention and the invention is not to be limited thereto, except insofar as the appended claims are so limited, since those skilled in the art who have disclosure before them will be able to make modifications and variations therein without departing from the scope of the invention.

I claim:

1. In a filing cabinet comprising a frame mounting a plurality of superposed drawers for independent horizontal shifting movement between open and closed positions, and a safety latch arrangement, for precluding the movement of more than one of said drawers at a time from said closed to said open position, including a vertically disposed latch bar mounted adjacent the drawers and means for actuating said bar, when one of the drawers is moved to open position, to latch the remaining drawers against movement to open position, the improvement wherein the cabinet includes a drawer movement sequencing device, said device comprising:

a vertically disposed slideway positioned along one side of the drawers, said slideway having disposed therein a latch bar segment for operative association with each of said drawers, said segments being in discrete vertically stacked relation and being mounted in said slideway for vertical movement therealong from an inoperative at rest position lengthwise of the slideway, said segments each including:

a lower lug disposed at the level of the drawer with which the respective segments are to be operatively associated and an upper lug disposed at the level of the next vertically adjacent upper drawer, said drawers each including on said side of same a cam member disposed to cooperate with the lower lug of the latch bar segment that is operatively associated therewith, said cam members each defining:

forward and rearward upwardly facing ramp surfaces separated by an elevated upwardly facing horizontal guide surface, and a downwardly facing horizontal abutment surface, said lower lugs of said segments being elevationally located thereon to dispose the lower lug of the respective segments, in said at rest position thereof, at the level of and for camming engagement by said ramp surfaces of the cam member of the drawer operatively associated therewith, said upper lugs of said segments being elevationally located thereon, in the at rest position of said segments, to dispose the upper lugs of the respective segments, adjacent to but below the level of the cam member abutment surface of the next vertically adjacent upper drawer, for abutting engagement therewith, whereby, when a lower segment is elevated by moving a first lower drawer from its closed position toward its open position, the cam member of such lower drawer at its upwardly facing surfaces engages the lower lug of the latch bar segment operatively associated therewith to cam same and the segments supported thereon upwardly whereby a second drawer above such moving lower drawer if also moving toward its open position has its cam member abutment surface jammingly engaged by the upper lug of the latch bar segment operatively associated with the drawer next vertically adjacent and below such second drawer, whereby further outward movement of such lower moving drawer is blocked by those of said segments between such lower and upper drawer cam members while permitting such second drawer to be moved to its open position to actuate said latch bar actuating means to preclude further drawers from being moved to open position.

2. The improvement set forth in claim 1 wherein: said device further comprises:

stop means for limiting maximum vertical upward movement of said segments whereby if the first lower drawer is moved sufficiently toward its open position whereby the latch bar segment operatively associated therewith and the segments supported thereby are elevated such that the cam member of the second drawer has its upwardly facing surfaces brought into engagement with the upper lug of the latch segment operatively associated with the drawer next below same, said stop means holds the latch bar segment at the second drawer against further upward vertical movement to preclude further outward movement of such second drawer.

3. The improvement set forth in claim 1 wherein: said cam members each comprise:

a body formed from a self lubricating material, said body being formed to define spaced studs tangent with said downwardly facing surface thereof and an internally threaded sleeve portion intermediate said studs that is recessed relative to said studs, said drawers at said one side thereof being apertured to receive said studs and indented outwardly of the drawer intermediate said apertures for alignment with said sleeve portion, and fastener means connecting the respective drawer indentations to the respective drawer cam body sleeve portions.

4. The improvement set forth in claim 2 wherein:

said slideway is defined by an upright frame member of said cabinet, said frame member being shaped to form an elongate channel facing the drawer said one sides in which said segments are slidably mounted, and retainer means secured across said channel to hold said segments in stacked relation in said channel.

5. The improvement set forth in claim 4 wherein:

said frame member adjacent the lower end of same is formed to define a rest on which said segments are supported in their at rest position.

6. The improvement set forth in claim 4 wherein:

said stop means comprises a pin disposed across said channel at the upper end of same.

7. In a filing cabinet comprising a frame mounting a plurality of superposed drawers for independent horizontal shifting movement between open and closed positions, a safety latch and drawer movement sequencing arrangement for precluding the movement of more than one of said drawers at a time from said closed to said open position, said arrangement comprising:

a safety latch device comprising:

a vertically disposed latch bar along one side of and spanning said drawers and mounted for movement longitudinally of said bar between drawer locking and release positions, said bar carrying, for each of said drawers, a cam follower disposed adjacent said sides of the respective drawers, respectively, said drawers each carrying on said sides thereof:

cam means for camming the respective cam followers to shift said bar vertically between its drawer release and locking positions when the respective drawers are moved between their closed and open positions, and stop means disposed on the respective drawers to engage the cam follower of unopened drawers when one of the drawers is moved toward open position to thereby shift said bar to said locking position, and a drawer movement sequencing device, said movement sequencing device comprising:

a vertically disposed slideway positioned along the other side of the drawers, said slideway having disposed therein a latch bar segment for operative association with each of said drawers, said segments being in discrete vertically stacked relation and being mounted in said slideway for vertical movement therealong from an inoperative at rest position lengthwise of the slideway, said segments each including:

a lower lug disposed at the level of the drawer with which the respective segments are to be operatively associated and an upper lug disposed at the level of the next vertically adjacent upper drawer, said lugs projecting toward said drawers, said drawers each including on said other side of same a cam member disposed to cooperate with the lower lug of the latch bar segment that is operatively associated therewith, said cam members each defining:

forward and rearward upwardly facing ramp surfaces separated by an elevated upwardly facing horizontal guide surface, and a downwardly facing horizontal abutment surface, said lower lugs of said segments being elevationally located thereon to dispose the lower lug of the respective segments, in said at rest position thereof, at the level of and for camming engagement by said ramp surfaces of the cam member of the drawer operatively associated therewith, said upper lugs of said segments being elevationally located thereon, in the at rest position of said segments, to dispose the upper lugs of the respective segments, adjacent to but below the level of the cam member abutment surface of the next vertically adjacent upper drawer, for abutting engagement therewith, whereby when a lower segment is elevated by moving a first lower drawer from its closed position toward its open position, the cam member of such lower drawer at its upwardly facing surfaces engages the lower lug of the latch bar segment operatively associated therewith to cam same and the segments supported thereon upwardly whereby a second drawer above such moving lower drawer if also moving toward its open position has its cam member abutment surface jammingly engaged by the upper lug of the latch bar segment operatively associated with the drawer next vertically adjacent and below such second drawer, whereby further outward movement of such lower moving drawer is blocked by those of said segments between such lower and upper drawer cam members, said devices being located relative to the respective drawers for sequential activation of said sequencing device and said safety latch device in that order on movement of said drawers from their positions toward their open positions.

8. The arrangement set forth in claim 7 wherein:

said cam members of said drawer movement sequencing device each comprise a body formed from self lubricating material.

9. The arrangement set forth in claim 8 wherein:

said latch bar segments of said drawer movement sequencing device are formed from a nonmetallic material.

10. The arrangement set forth in claim 8 wherein:

said latch bar segments of said drawer movement sequencing device have the lower lugs thereof, on the undersides of same, angled at the same angles as said ramp surfaces.

11. The arrangement set forth in claim 8 wherein:

said cam followers of said latch bar are formed from a self lubricating material.

12. The improvement set forth in claim 7 wherein:

said sequencing device further comprises:

stop means for limiting maximum vertical upward movement of said segments whereby if the first lower drawer is moved sufficiently toward its open position whereby the latch bar segment operatively associated therewith and the segments supported thereby are elevated such that the cam member of the second drawer has its upwardly facing surfaces brought into engagement with the upper lug of the latch segment operatively associated with the drawer next below same, said stop means holds the latch bar segment of the second drawer against further upward vertical movement to preclude further outward mmovement of such second drawers.

13. In a filing cabinet comprising a frame mounting a plurality of superposed drawers for independent horizontal shifting movement between open and closed positions, and a safety latch arrangement, for precluding the movement of more than one of said drawers at a time from said closed to said open position, including a latching device operative, when one of the drawers is moved to open position, to latch the remaining drawers against movement to open position, the improvement wherein the cabinet includes a drawer movement sequencing device, said device comprising:

a vertically disposed slideway positioned along one side of the drawers, said slideway having disposed therein a latch bar segment for operative association with each of said drawers, said segments being in discrete vertically stacked relation and being mounted in said slideway for vertical movement therealong from an inoperative at rest position lengthwise of the slideway, said segments each including:

a lower lug disposed at the level of the drawer with which the respective segments are to be operatively associated and an upper lug disposed at the level of the next vertically adjacent upper drawer, said drawers each including on said side of same a cam member disposed to cooperate with the lower lug of the latch bar segment that is operatively associated therewith, said cam members each defining:

forward and rearward upwardly facing ramp surfaces separated by an elevated upwardly facing horizontal guide surface, and a downwardly facing horizontal abutment surface, said lower lugs of said segments being elevationally located thereon to dispose the lower lug of the respective segments, in said at rest position thereof, at the level of and for camming engagement by said ramp surfaces of the cam member of the drawer operatively associated therewith, said upper lugs of said segments being elevationally located thereon, in the at rest position of said segments, to dispose the upper lugs of the respective segments, adjacent to but below the level of the cam member abutment surface of the next vertically adjacent upper drawer, for abutting engagement therewith, whereby, when a lower segment is elevated by moving a first lower drawer from its closed position toward its open position, the cam member of such lower drawer at its upwardly facing surfaces engages the lower lug of the latch bar segment operatively associated therewith to cam same and the segments supported thereon upwardly whereby a second drawer above such moving lower drawer if also moving toward its open position has its cam member abutment surface jammingly engaged by the upper lug of the latch bar segment operatively associated with the drawer next vertically adjacent and below such second drawer, whereby further outward movement of such lower moving drawer is blocked by those of said segments between such lower and upper drawer cam members while permitting such second drawer to be moved to its open position to actuate said latching means to preclude further drawers from being moved to open position.

14. The improvement set forth in claim 13 wherein:

said device further comprises:

stop means for limiting maximum vertical upward movement of said segments whereby if the first lower drawer is moved sufficiently toward its open position whereby the latch bar segment operatively associated therewith and the segments supported thereby are elevated such that the cam member of the second drawer has its upwardly facing surfaces brought into engagement with the upper lug of the latch segment operatively associated with the drawer next below same, said stop means holds the latch bar segment at the second drawer against further upward vertical movement to preclude further outward movement of such second drawer.

* * * * *

UNITED STATES PATENT OFFICE

CERTIFICATE OF CORRECTION

Patent No. 3,969,008 Dated July 13, 1976

Inventor(s) CHARLES C. PERGLER

It is certified that error appears in the above-identified patent and that said Letters Patent are hereby corrected as shown below:

Column 15, line 5, between "their" and "open" insert --closed positions toward their--.

Signed and Sealed this

Nineteenth Day of October 1976

[SEAL]

*Attest:*

RUTH C. MASON
*Attesting Officer*

C. MARSHALL DANN
*Commissioner of Patents and Trademarks*